US005586671A

United States Patent [19]

Thomas et al.

[11] Patent Number: 5,586,671

[45] Date of Patent: Dec. 24, 1996

[54] CHILD RESISTANT PACKAGE

[75] Inventors: Hewin N. Thomas; Jack E. Haney, both of Norcross, Ga.; Peter W. Hamilton, Cincinnati, Ohio

[73] Assignee: The Procter & Gamble Company, Cincinnati, Ohio

[21] Appl. No.: 602,877

[22] Filed: Feb. 23, 1996

Related U.S. Application Data

[63] Continuation of Ser. No. 382,736, Feb. 2, 1995, abandoned, which is a continuation-in-part of Ser. No. 103,476, Aug. 6, 1993, abandoned.

[51] Int. Cl.[6] ..... B65D 50/08

[52] U.S. Cl. ..... 215/209; 215/213; 215/221; 215/344; 215/354

[58] Field of Search ..... 215/209, 213, 215/221, 344, 354, DIG. 1

[56] References Cited

U.S. PATENT DOCUMENTS

| | | | |
|---|---|---|---|
| Re. 27,673 | 6/1973 | Landen . | |
| 2,964,207 | 12/1960 | Towns . | |
| 3,074,579 | 1/1963 | Miller | 215/DIG. 1 |
| 3,101,856 | 8/1963 | Whiteman, Jr. . | |
| 3,110,411 | 11/1963 | Golde . | |
| 3,185,333 | 5/1965 | Sharp . | |
| 3,200,979 | 8/1965 | Powers . | |
| 3,233,769 | 2/1966 | Jessop . | |
| 3,306,482 | 2/1967 | Tuuri . | |
| 3,360,147 | 12/1967 | Schaefer . | |
| 3,394,829 | 7/1968 | Peterson . | |
| 3,445,022 | 5/1969 | Cilluffo . | |
| 3,472,409 | 10/1969 | Slack et al. . | |
| 3,531,008 | 9/1970 | Achabal et al. . | |
| 3,567,057 | 3/1971 | Landen . | |
| 3,700,133 | 10/1972 | Bagguley . | |
| 3,744,655 | 7/1973 | Nixdorff, Jr. . | |
| 3,757,979 | 9/1973 | Berghahn . | |
| 3,773,203 | 11/1973 | Grimaldi et al. . | |
| 3,794,200 | 2/1974 | Marks . | |
| 3,794,201 | 2/1974 | Galer . | |
| 3,811,589 | 5/1974 | Thornton et al. . | |
| 3,830,392 | 8/1974 | Kessler et al. . | |
| 3,848,780 | 11/1974 | Stull . | |
| 3,857,508 | 12/1974 | LaBarge et al. . | |
| 3,865,267 | 2/1975 | Morris . | |
| 3,870,182 | 3/1975 | Georgi . | |
| 3,877,597 | 4/1975 | Montgomery et al. . | |
| 3,881,625 | 5/1975 | Landen . | |
| 3,884,379 | 5/1975 | Landen . | |
| 3,888,373 | 6/1975 | Gach et al. | 215/344 X |
| 3,891,110 | 6/1975 | Gach . | |
| 3,892,326 | 7/1975 | Schneible . | |
| 3,894,647 | 7/1975 | Montgomery . | |

(List continued on next page.)

FOREIGN PATENT DOCUMENTS

| | | | |
|---|---|---|---|
| 2832276 | 1/1980 | Germany | 215/DIG. 1 |
| 609942 | 3/1979 | Switzerland | 215/DIG. 1 |

*Primary Examiner*—Stephen Cronin
*Attorney, Agent, or Firm*—Elizabeth M. Koch; Daniel F. Nesbitt; William Scott Andes

[57] ABSTRACT

A package suitable for storing and dispensing potentially dangerous materials. The package is resistant to opening by children but readily openable by adults, particularly adults having impaired manual dexterity of their hands and/or fingers. The package includes a bottle having a finish portion. The finish portion has a platform with at least one resiliently deformable pushtab secured to the platform. The resiliently deformable pushtabs contain a vertical extensions which engage the interlocking pawls on the innermost surface of the closure skirt when the closure is fully assembled onto the finish portion. To remove the closure, the opposed pushtabs must be depressed prior to unscrewing to the closure to disengage the pushtab extensions from the interlocking pawls on the closure. The package further includes a means for sealing the cap to the finish portion of the bottle when the cap is rotatably secured onto the finish portion so that after the cap is rotatably secured onto the finish portion, the cap can be rotated in a reverse direction without disengaging the pushtab and without unsealing the cap from the finish portion.

19 Claims, 7 Drawing Sheets

U.S. PATENT DOCUMENTS

| | | | |
|---|---|---|---|
| 3,895,730 | 7/1975 | Koehne et al. . | |
| 3,900,123 | 8/1975 | Darlington . | |
| 3,901,400 | 8/1975 | Westfall . | |
| 3,901,404 | 8/1975 | Feldman | 215/256 |
| 3,917,097 | 11/1975 | Uhlig . | |
| 3,984,021 | 10/1976 | Uhlig . | |
| 3,989,152 | 11/1976 | Julian . | |
| 3,993,208 | 11/1976 | Ostrowsky . | |
| 3,993,209 | 11/1976 | Julian . | |
| 4,002,259 | 1/1977 | Geiser . | |
| 4,016,996 | 4/1977 | Aichinger | 215/344 |
| 4,036,385 | 7/1977 | Morris . | |
| 4,103,797 | 8/1978 | Morris | 215/209 |
| 4,138,028 | 2/1979 | Price et al. | 215/216 |
| 4,149,646 | 4/1979 | Julian | 215/216 |
| 4,154,353 | 5/1979 | Hoo | 215/209 |
| 4,204,615 | 5/1980 | McCarthy | 222/153 |
| 4,210,251 | 7/1980 | Grussen | 215/329 |
| 4,213,534 | 7/1980 | Montgomery | 215/216 |
| 4,223,794 | 9/1980 | Morris | 215/220 |
| 4,270,664 | 6/1981 | Buono | 215/216 |
| 4,285,437 | 8/1981 | Morris | 215/220 |
| 4,322,012 | 3/1982 | Conti | 215/344 |
| 4,331,247 | 5/1982 | Mumford | 215/216 |
| 4,335,823 | 6/1982 | Montgomery et al. | 215/206 |
| 4,337,869 | 7/1982 | Guinle | 215/201 |
| 4,345,690 | 8/1982 | Hopley | 215/216 |
| 4,351,442 | 9/1982 | Summers | 215/216 |
| 4,353,473 | 10/1982 | Morris | 215/220 |
| 4,427,124 | 1/1984 | Marshall et al. | 215/216 |
| 4,473,162 | 9/1984 | Donoghue | 215/209 |
| 4,574,966 | 3/1986 | Sandhaus | 215/270 |
| 4,690,292 | 9/1987 | Henning | 215/201 |
| 4,782,965 | 11/1988 | Wassilieff | 215/220 |
| 4,782,966 | 11/1988 | Thackrey | 215/230 |
| 4,892,208 | 1/1990 | Sledge | 215/216 |
| 4,913,299 | 4/1990 | Petro | 215/330 |
| 4,930,647 | 6/1990 | Dutt et al. | 215/252 |
| 4,948,002 | 8/1990 | Thornock et al. | 215/221 |
| 5,009,323 | 4/1991 | Montgomery et al. | 215/252 |
| 5,038,454 | 8/1991 | Thornock et al. | 29/451 |
| 5,145,080 | 9/1992 | Imbery, Jr. | 215/331 |
| 5,147,053 | 9/1992 | Friedenthal | 215/216 |
| 5,213,225 | 5/1993 | King et al. | 215/330 |
| 5,230,433 | 7/1993 | Hamilton et al. | 215/221 |
| 5,265,751 | 11/1993 | Lima et al. | 220/288 |
| 5,271,512 | 12/1993 | Ekkert | 215/252 |

CHILD RESISTANT PACKAGE

This is a continuation of application Ser. No. 08/382,736, filed on Feb. 2, 1995 now abandoned. which is a continuation of application Ser. No. 08/103,476, filed on Aug. 6, 1993 now abandoned.

FIELD OF THE INVENTION

The present invention has relation to a package for storing and dispensing materials which can be harmful, particularly if improperly ingested. Such materials may be in solid, tablet, granular, powdered, semi-solid paste or liquid form.

The present invention has further relation to such a package which is resistant to opening by the majority of children coming in contact with it, yet which can be opened without undo difficulty by adults whose manual dexterity may, at least to a degree, be impaired.

The present invention has further relation to such a package which can be inexpensively and easily manufactured to facilitate disposal thereof once the contents have been completely dispensed from the package.

BACKGROUND INFORMATION

Child resistant packaging is a great concept for preventing children from opening potentially dangerous materials such as medications, but for adults, especially the elderly, such packaging can be a nuisance. However, simply making the contents of the package more easily accessible to the elderly bears with it the risk that the contents could be accessible to children who could be injured if they obtain access to the contents of a package and ingest the contents contained therein.

Attempts to deal with the aforementioned problems are disclosed in the patent literature. For example, U.S. Pat. No. 3,993,208 issued to Ostrowsky on Nov. 23, 1976 discloses a safety closure means wherein the shoulder on a container is formed with a pair of diametrically positioned locking lugs. The mating closure is formed of thermoplastic material and has a top end wall and a depending annular inner wall in addition to a depending outer annular skirt spaced from the inner wall. The inner wall includes threaded means for engaging the neck of the container to secure the cap to the container in a closed position. The outer skirt of the cap has a pair of diametrically positioned radially extending locking lugs adjacent the lower end of the skirt. The cap locking lugs are adapted to pass inwardly of the container locking lugs and to be compressed radially inwardly when the cap is rotated to a cap closing position. As the cap lugs move past the container locking lugs, the cap lugs are released from their compressed condition so that they extend outwardly beyond the engaging edges of the container locking lugs. This prevents the closure from being unscrewed until the outer skin of the closure is manually squeezed radially inwardly adjacent the cap locking lugs to permit them to clear engagement with the edges of the container lugs as the cap is unscrewed from the container.

Under normal in use conditions, removal of the closure of Ostrowsky requires squeezing the outer skin of the closure sufficiently to disengage the lugs on the container and simultaneously unscrewing the closure with the same hand used to apply the squeezing force. This may be difficult, particularly for elderly persons who may have impaired manual dexterity and strength.

In addition, the closure of Ostrowsky visually reveals how the interlocks must be overcome in order to remove the closure. A child having sufficient strength to depress the closure skin may have sufficient intellect to defeat the interlock and remove the closure.

Another prior an attempt to overcome the aforementioned problems is disclosed in commonly assigned U.S. Pat. No. 4,948,002 issued to Thomock et al. on Aug. 14, 1990. The Thornock et al. patent discloses a package comprising a bottle, a collar which is secured in place over the uppermost portion of the bottle and a closure which is secured to the finish portion of the bottle by means of complementary screw threads. The collar preferably includes a pair of spring-like pushtabs containing vertical extensions which engage interlocking teeth on the innermost surface of the closure skin when the closure skirt is fully assembled onto the bottle. To remove the closure, the opposed pushtabs must be manually depressed prior to applying unscrewing torque to the closure to disengage the pushtab extensions from the interlocking teeth on the closure. While the Thornock et al. patent discloses a package exhibiting highly improved child resistance without significantly impeding access by adults, the disclosed collar arrangement creates an element which must be secured to the finish portion of the bottle adding to the overall cost of this package and a assembly operations needed to produce the package.

Closures such as those mentioned above are satisfactory in sealing non-flowable solid product, i.e. tablets or capsules. The sealing is done by a flat seal atop the bottle finish. After the closure is secured into place and the child resistant feature is latched, it is desired to have the closure such that it can be turned in the off direction for a small distance, without activating the child resistant feature, causing a gap to form between the bottle finish and the portion of the cap which is supposed to seal the container. This gap is typically the result of an intentional design feature, that is providing some "over-travel" or "bypass" of the closure, defined as the radial rotation of the cap past the engagement of the push tabs, i.e. the point where the tabs ride over the cap lugs, and cause an audible click. This bypass is useful and necessary since the package will tend to jam if the tab engagement position is closely proximal to the point at which the cap liner seals the bottle finish. This problem will be exacerbated by typical molding tolerance variations of the cap and/or bottle finish as well as cap liner thickness variations. Without a bypass design, the cap may seal the finish before engagement with the tabs, resulting in a package which will not close. Conversely, the tabs may engage well before the bottle is sealed resulting in a package which may leak when filled with liquid or powder products.

Accordingly, it is an object of the present invention to provide a package having a child resistant feature which is resistant to opening by the majority of children coming in contact with the package and which at the same time can readily be opened by adults who may have impaired manual dexterity in their fingers due to conditions such as advancing age, arthritis, etc.

It is another object of the present invention to provide such a package wherein the cap can rotate onto the package past the engagement of the child resistant feature, and provide for adequate sealing of the cap onto the closure at or before engagement of the child resistant feature so as to accommodate liquid or powder products.

It is another object of the present invention to provide a package having a child resistant feature wherein the child resistant feature is integrally molded into the bottle such that the child resistant feature of the bottle is complete in a single operation without the need for any further assembly operations to secure the child resistant feature to the bottle.

SUMMARY OF THE INVENTION

In a particularly preferred embodiment, the present invention provides a package suitable for storing and dispensing potentially dangerous material. The package is resistant to opening by children yet readily openable by adults: The package includes a bottle having a base and a finish portion. The finish portion has an innermost surface and an outermost surface. The finish portion includes a first means for rotatably and releasably securing a closure to the finish portion on at least one of its surfaces. The platform extends radially outward from the finish portion. The platform has an outermost surface which is generally concentrically aligned with the finish portion. The finish portion includes at least one resiliently deformable pushtab having a first end and a second end. At least one of the ends of the resiliently deformable pushtab is secured to the platform. The pushtab has an uppermost, lowermost, and an outermost surfaces. The outermost surface is generally concentrically aligned with the finish portion and generally conforms to the contour of the exterior surface of the adjacent portions of the platform to minimize the chance of inadvertent depression thereof when the platform is grasped. The pushtab has a vertical extension projecting above the uppermost surface of the pushtab. The pushtab is inwardly moveable relative to the rest of the platform when a force is applied to the outermost surface of the pushtab.

The package includes closure having a skirt with innermost and outermost surfaces. The skirt includes on at least one of its surfaces second means complementary to the first means for rotatably and releasably securing the closure to the finish portion. The skirt also has at least one interlocking pawl on its innermost surface. The interlocking pawl being so shaped and positioned that it will deflect the vertical extension of the resiliently deformable pushtab when the closure is rotatably secured onto the finish portion, but will prevent removing the closure from the finish portion by rotating the closure in a reverse direction unless the resiliently deformable pushtab is first depressed to disengage the pushtab vertical extension form the interlocking pawl.

The package further includes a means for sealing the cap to the finish portion of the bottle when the cap is rotatably secured onto the finish portion so that after the cap is rotatably secured onto the finish portion, the cap can be rotated in a reverse direction without disengaging the pushtab and without unsealing the cap from the finish portion.

Preferably the first and second means for rotatably and releasably securing the closure to the finish portion comprises complementary screw threads. In a preferred embodiment the platform includes a pair of opposed resiliently deformable pushtabs. The platform includes a pushtab stop preventing the pushtab from being depressed too far inwardly causing damage to the pushtab.

In another preferred embodiment, both the first and second ends of the pushtab are secured to the platform

BRIEF DESCRIPTION OF THE DRAWINGS

While the specification concludes with claims particularly pointing out and distinctly claiming the present invention, it is believed that the present invention will be better understood from the following description in conjunction with the accompanying drawings in which:

DETAILED DESCRIPTION OF THE INVENTION

Figure 2:
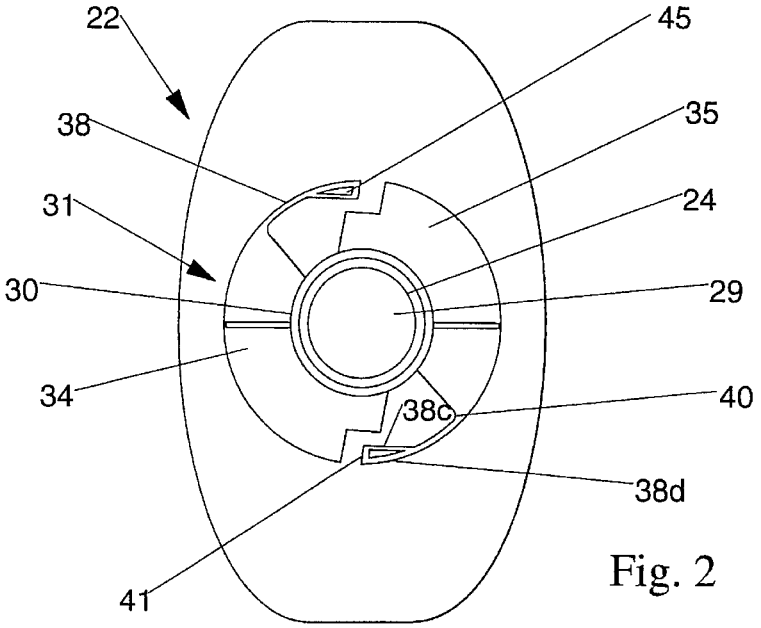
FIG. 2 is a top plan view of the bottle of FIG. 1.
Figure 1:
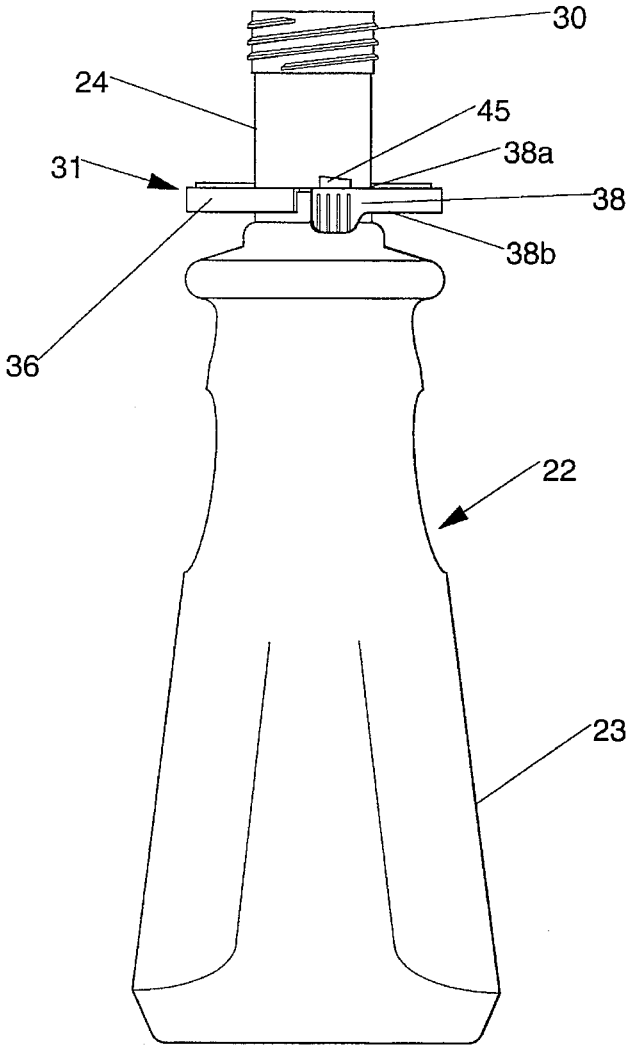
FIG. 1 is a side elevation view of a particularly preferred bottle of the present invention wherein the finish portion includes an integrally molded child resistant feature.
Figure 3:
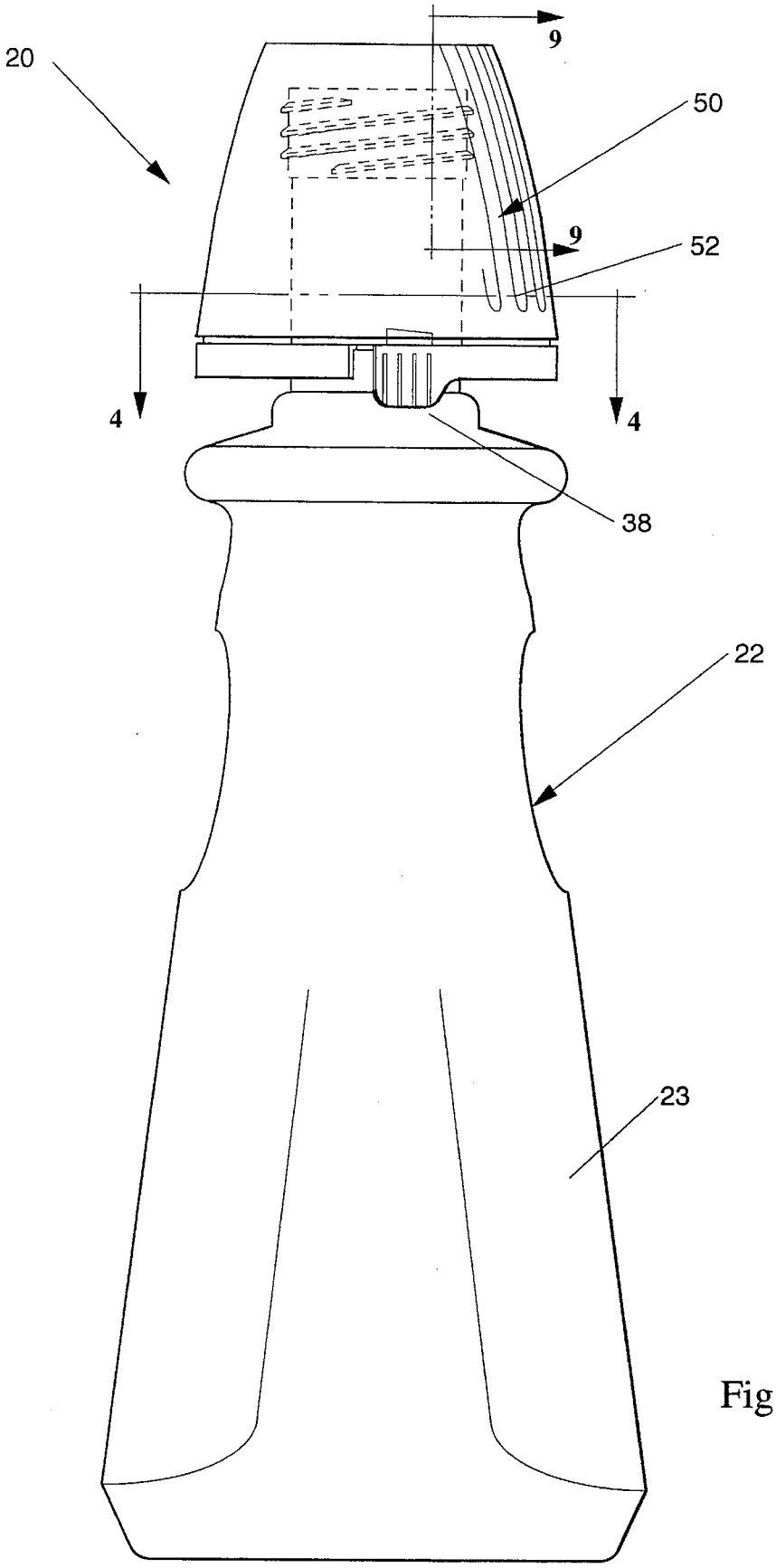
FIG. 3. is a side elevation view of a particularly preferred package of the present invention.

FIGS. 1–3 show a preferred child resistant package 20 of the present invention. Package 20 may be used for storing and dispensing nearly any potentially dangerous material whether in solid, tablet, granular, powdered, semi-solid, paste, or liquid form. Package 20 includes a bottle 22 and a closure 50. Bottle 22 and closure 50 are preferably molded of polypropylene, polyethylene, polyester, polyvinyl chloride, polystyrene, polycarbonate, or the like.

Bottle 22 has a base portion 23 and a cylindrical finish portion 24. Finish portion 24 includes an opening 29 and helical threads 30 on its outermost surface. While any suitable securement means, e.g., a combination of lugs or screw threads, can be employed to rotatably and releasably secure closure 50 onto finish portion 24, complementary threads on the inner surface of closure 50 are particularly 35 preferred.

The threads 30 on the exterior surface of finish portion 24 are preferably double lead threads and are complementary to the threads on the innermost surface of closure 50. The pitch of threads 30 and the threads on closure 50 are preferably such that closure 50 is fully seated onto finish portion 24 with approximately 180° of rotation.

Referring now to FIGS. 1 and 2, the finish portion 24 includes a child resistant feature, generally designated 31, at the opposite end from opening 29. The child resistant feature 31 is integrally molded with the finish portion 24. Child resistant feature 31 includes a platform 34 extending radially outward from finish portion 24. Platform 34 has a substantially planar surface 35 and an outermost surface 36. The outermost surface 36 of platform 34 is generally concentrically aligned with the finish portion 24. Extending from and secured to platform 34 is a pair of pushtabs 38. Pushtabs 38 include an uppermost surface 38*a*, a lowermost surface 38*b*, an innermost surface 38*c*, and an outermost surface 38*d*. The outermost surface 38*d* is generally concentrically aligned with the finish portion 24 and generally conforms to the contour of the outermost surface 36 of platform 34. Pushtabs include a first end 40 and a secured end 41. First end 40 is secured to platform 34. At the junction of first end 40 of pushtab 38 with platform 34 is a radiused portion which allows the pushtab 38 to flex inward. In the embodiment of FIGS. 1–3, pushtab 38 behaves like a cantilever beam.

Figure 4A:
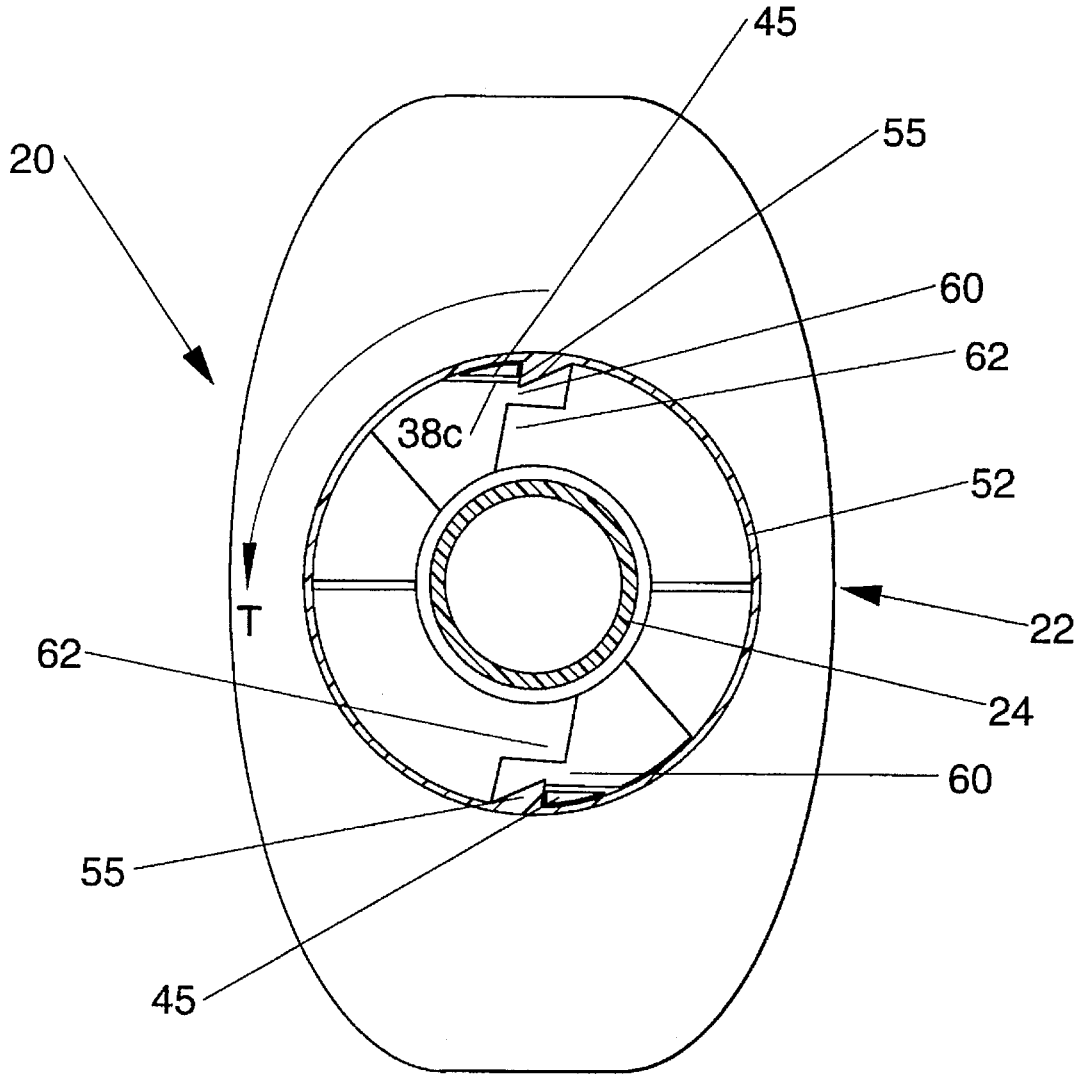
FIG. 4A. is a cross-sectional view of the package of FIG. 3 taken along section line 4—4 of FIG. 3 with the pushtabs in the extended condition.

The uppermost surface of each pushtab 38 has a vertical extension 45 which projects above the plane of the uppermost surface 38*a* of pushtab 38. Referring now to FIG. 4A, vertical extensions 45 interlock with pawls 55 on the innermost surface of skirt portion 52 of closure 50 when closure 50 is fully threaded onto finish portion 24. During assembly of closure 50 onto finish portion 24, pawls 55 must rotate past vertical extensions 45. However, vertical extensions 45 interfere with the rotation of pawls 55 and cause pushtabs 38 to be resiliently deflected inwardly. Gradual lead-in ramps on pawls 55 facilitate the deflection. In general it is preferred that the lead in ramps exhibit a gradual inwardly directed taper so as to avoid a sudden increase in the reapplication torque required to fully seat the closure 50 onto the finish portion 24. If desired, the mating surface of vertical extensions 45 may also be profiled, as generally shown in FIGS. 2 and 4A, to minimize the reapplication torque required to fully seat the closure 50 onto the finish portion 24. Both of these features help to ensure that the user will properly reapply the closure to restore child resistance to the package after the package has been opened.

Continued rotation of closure 50 causes pawls 55 to clear the vertical extensions 45, thereby permitting vertical extensions 45 and pushtabs 38 to resiliently return to their latched condition shown is FIG. 4A the child resistant feature 31 may be molded so that pushtabs 38 and vertical extensions 45 exhibit an unrestrained at rest position wherein the maximum exterior dimension, is measured across the opposed vertical extensions 45 is substantially equal to or slightly less than the inside diameter of skirt 52, as measured in the area where pawls 55 are not present. Alternatively, the child resistant feature 31 may be molded so that the vertical extensions 45 exhibit an unrestrained maximum exterior dimension which is somewhat greater than the inside diameter of the closure skirt 52, in this situation, application of closure 50 to finish portion 24 results in preloading of the vertical extensions 45 against the interior surface of skirt 52 when the closure 50 is fully seated as shown in FIG. 4A.

The arrangement of threads 30 and those on the interior surface of skirt 52 of closure 50 in conjunction with vertical extensions 45 and pawls 55 is such that the latching of pawls 55 past the vertical extensions 45 occurs nearly simultaneously with the seating of closure 50 onto finish portion 24. This is readily achievable, since the thread 30 is integrally molded with the finish portion 24 that includes the integrally molded pushtabs 38, and vertical extensions 45, while the internal thread on the interior surface of skirt 52 of the closure 50 is integrally molded with the closure 50 which includes pawls 55.

With pushtabs 38 in the position shown in FIG. 4A, vertical extensions 45 impede counter-clockwise rotation of pawls 55 preventing attempts to reopen the container by rotating the closure 50 in the counter-clockwise direction indicated by arrow "T".

Clearance in opening 60 between the innermost surface 38*c* of pushtab 38 and the pushtab stop 62 permits sufficient inward deflection of pushtabs 38 from the position shown in FIG. 4A such that vertical extensions 45 will clear pawls 55 when the user concurrently depresses pushtabs 38 and applies an unscrewing torque in the direction of arrow "T" to the closure 50.

Figure 4B:
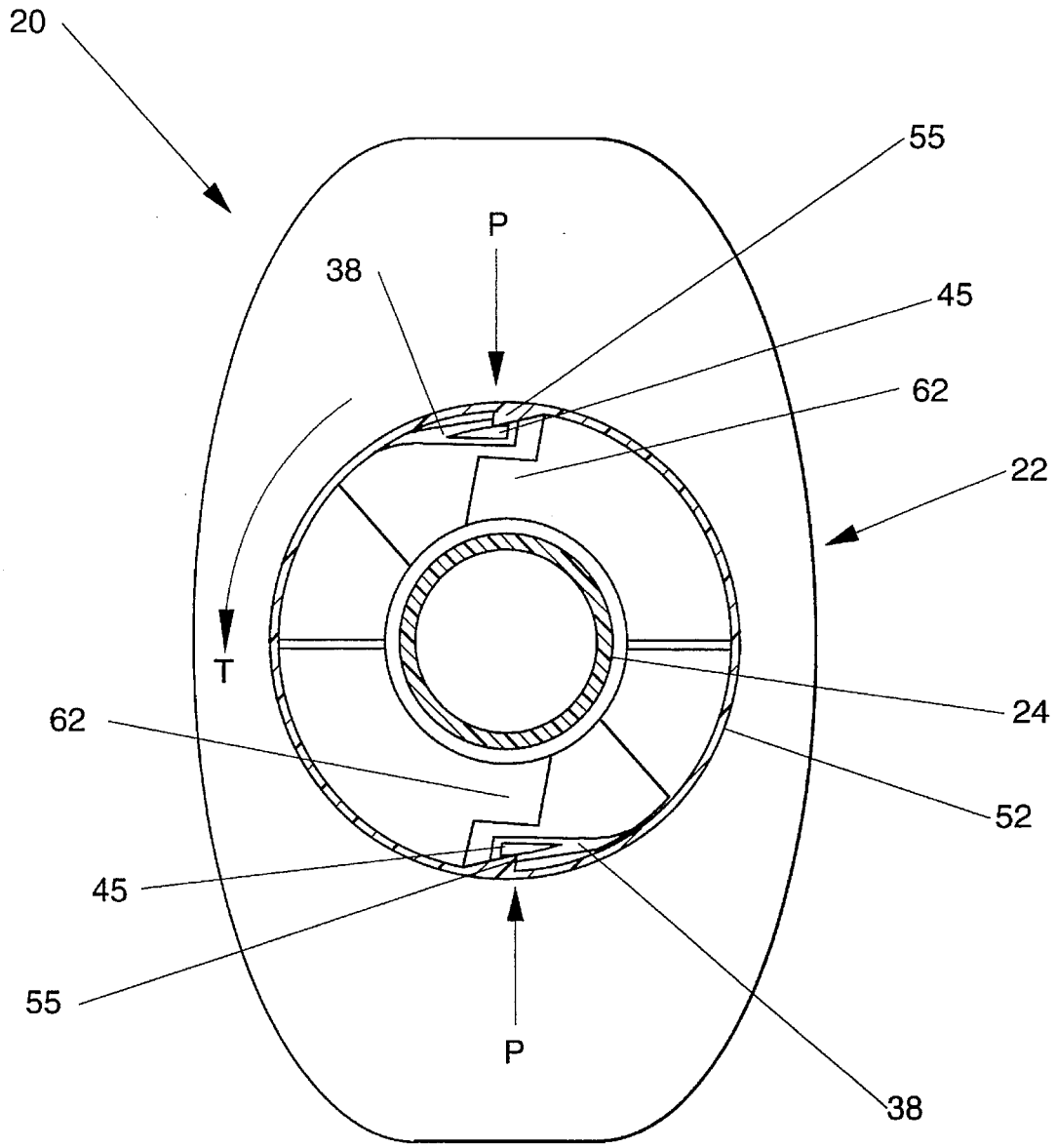
FIG. 4B is a cross-sectional view of the package of FIG. 3 taken along section line 4—4 of FIG. 3, with the pushtabs in the depressed condition.

FIG. 4B is a view of package 20 taken at a point corresponding to section line 4—4 of FIG. 3, but with pushtabs 38 deflected inwardly. In order to unscrew closure 50 from finish portion 24 once the closure has been fully assembled, sufficient manual pressure must be applied to opposed pushtabs 38 in the direction indicated by arrows "P" in FIG. 4A such that the vertical extensions 45 on pushtabs 38 disengage the pawls 55 on the innermost surface of skirt 52 of closure 50. The squeezing force required to depress pushtabs 38 is preferably great enough to be difficult for a child, yet low enough that adults can readily depress the opposing pushtabs 38 while concurrently applying an unscrewing torque in a direction of arrow "T" in FIG. 4B to the closure 50. The preferred squeezing force "P" or the pushtabs 38 to provide child resistance without imposing undue difficulty for adults with impaired manual dexterity is believed to be within the range of about 0.5 to about 5 pounds force. In addition, the diameter of the platform 34 is great enough that pushtabs 38 will be spaced sufficiently apart such that it will be difficult for a child to depress pushtabs 38 with one hand to release closure 50.

In addition, the outermost surface 38*a* of pushtabs 38 are preferably concentrically aligned with the finish portion 24 and generally conform to the contour of the exterior surface 36 of the platform 34 so that simply grasping the platform about its entire periphery and squeezing is unlikely to permit both the vertical extensions 45 on the opposed pushtabs 38 to become inadvertently disengaged from pawls 55 at the same time an unscrewing torque is being applied to the closure 50. Rather, a conscious decision to squeeze the opposing pushtabs 38 must be made by the user to initiate the opening process and this must be accompanied by a concurrent application of unscrewing torque to the closure 50 to proceed further. This minimizes the chance that a child will be able to remove closure 50 simply by squeezing the entire periphery of platform 34 in his or her hand while trying to unscrew closure 50.

In FIG. 4A it can be seen that vertical extensions 45 no longer impede counter-clockwise rotation of pawls 55 on skirt 52 in a direction indicated by the arrow "T". The user is then able to further rotate closure 50 in a counter-clockwise direction, thereby causing the closure 50 to rise above vertical extensions 45 and release the engagement of threads 30 and those on the interior surface of skirt 52. This permits closure 50 to be completely removed from finish portion 24.

Figure 6:
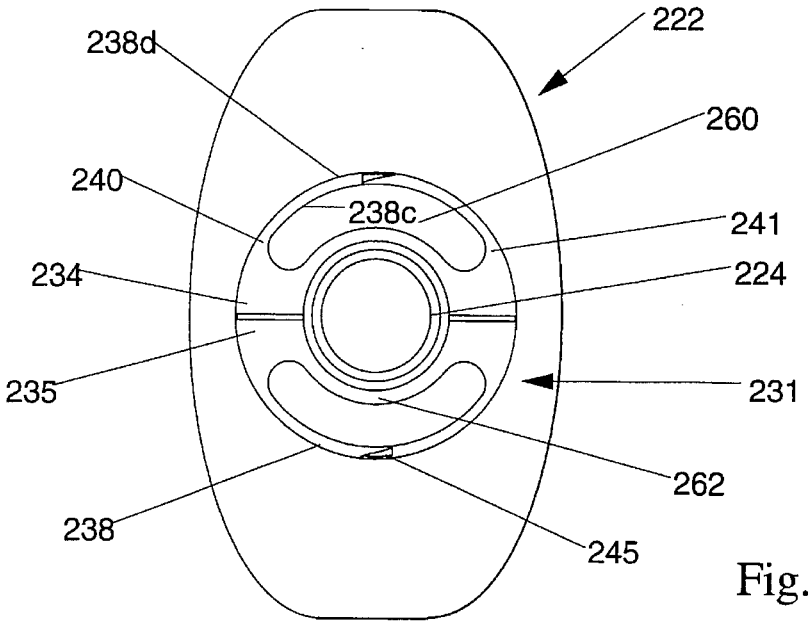
FIG. 6 is a top plan view of the bottle of FIG. 5.
Figure 5:
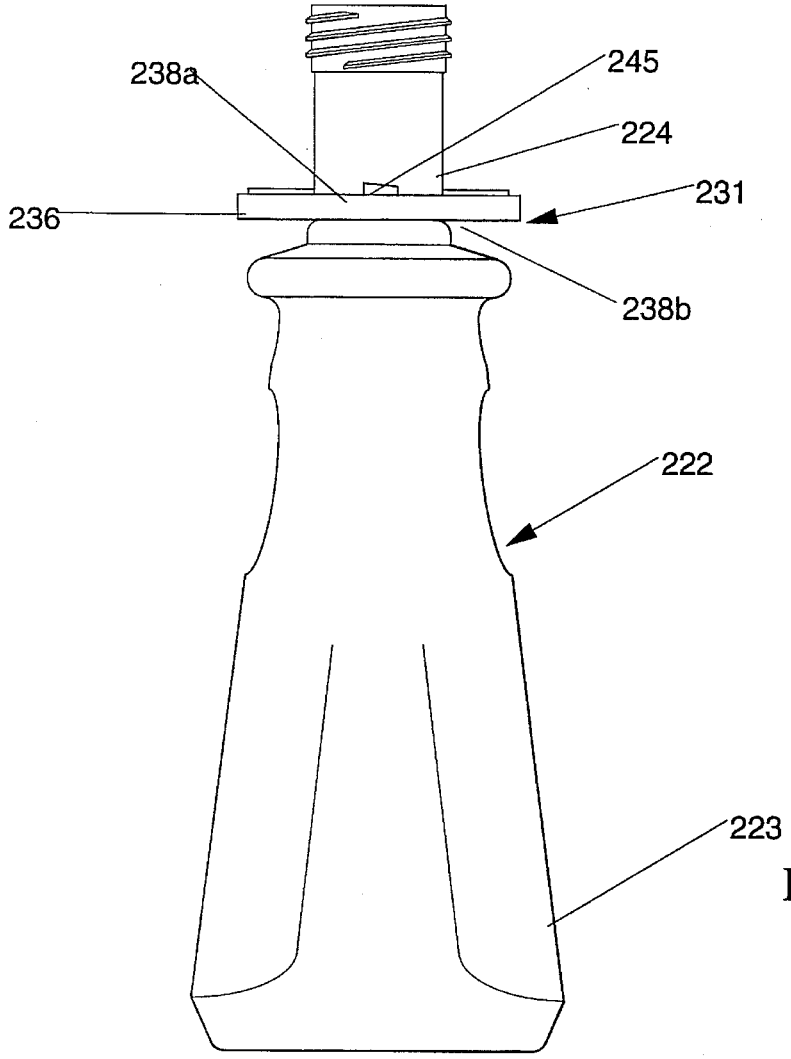
FIG. 5 is a side elevation view of another preferred embodiment of a bottle of the present invention wherein the finish portion includes an integrally molded child resistant feature.

FIGS. 5 and 6 show an alternative embodiment of a bottle 222 of the present invention. Bottle 222 comprises a base 223 and a cylindrical finish portion 224. Finish portion 224 includes threads 230 on its outermost surface. Finish portion 224 also includes a child resistant feature, generally designated 231. Child resistant feature 231 in integrally molded with the finish portion 224. Child resistant feature 231 includes a platform 234 extending radially outward from finish portion 224. The platform 234 has a substantially planar surface 235 and an outermost surface 236. The outermost surface 236 of platform 234 is generally concentrically aligned with the finish portion 224. Extending from and secured to platform 234 is a pair of pushtabs 238. Pushtabs 238 include an uppermost surface 238*a*, a lowermost surface 238*b*, an innermost surface 238*c*, and an outermost surface 238*d*. The outermost surface 238*a* is generally concentrically aligned with the finish portion 224 and generally conforms to the contours of the outermost surface 236 of platform 234. The pushtabs 238 include a first end 240 and a second end 241. Both the first end 240 and the second end 241 are secured to platform 234. At the junction of pushtab 238 with platform 234 is a radiused portion which allows pushtabs 238 to flex inward.

The uppermost surface of each pushtab 238 has a vertical extension 245 which projects above the plane of the uppermost surface 238*a* of pushtab 238. Vertical extensions 245 interlock with pawls 55 on the innermost surface of skirt 52 of closure 50, shown in FIGS. 3, 4A and 4B, when closure 50 is fully threaded onto finish portion 224. During assembly of closure 50 onto finish portion 224, pawls 55 must rotate past vertical extensions 45. However, vertical extensions 245 interfere with the rotation of pawls 55 and cause pushtabs 238 to be resiliently deflected inwardly. Gradual lead in ramps on pawls 55 facilitate the deflection. The mating surface of vertical extensions 245 is profiled to minimize the reapplication torque required to fully seat closure 50 onto finish portion 224. Continued rotation of closure 50 causes pawls 55 to clear vertical extension 245, thereby permitting pushtabs 238 to return to their latched condition.

Clearance in opening 260 between the innermost surface 238C of pushtab 238 and pushtab stop 262 permits sufficient inward deflection of pushtabs 238 to clear pawls 55 when the user wants to apply sufficient unscrewing torque to remove the closure from the finish portion 224.

While in an extended condition, similar to that shown in FIG. 4A, vertical extensions 245 impede counter-clockwise rotation of pawls 55 when attempting to remove the closure. In order to remove the closure from finish portion 224 once the closure has been fully assembled onto the finish portion, sufficient manual pressure must be applied to pushtab 238 such that vertical extensions 245 on pushtab 238 fully disengage pawls 55. The squeezing force required to depress pushtabs 238 is preferably great enough to be difficult for a child, yet low enough that adults can readily depress the opposing pushtab 238 while concurrently applying an unscrewing torque to the closure.

In addition, the outermost surface 238*a* of pushtab 238 are preferably concentrically aligned with finish portion 224 and conform to the contour of the exterior surface 236 of platform 234 so that simply grasping the platform about its periphery and squeezing is unlikely to permit both vertical extensions 245 on the opposed pushtabs 238 to become inadvertently disengaged from pawls 55 at the same time an unscrewing torque is being applied to the closure. Rather a conscious decision must be made by the user to initiate the opening process and this must be accompanied by a concurrent application of unscrewing torque to the closure. This minimizes the chance that a child will be able to remove the closure simply by squeezing the entire periphery of platform 234 in his or her hand while trying to unscrew the closure.

Figure 8:
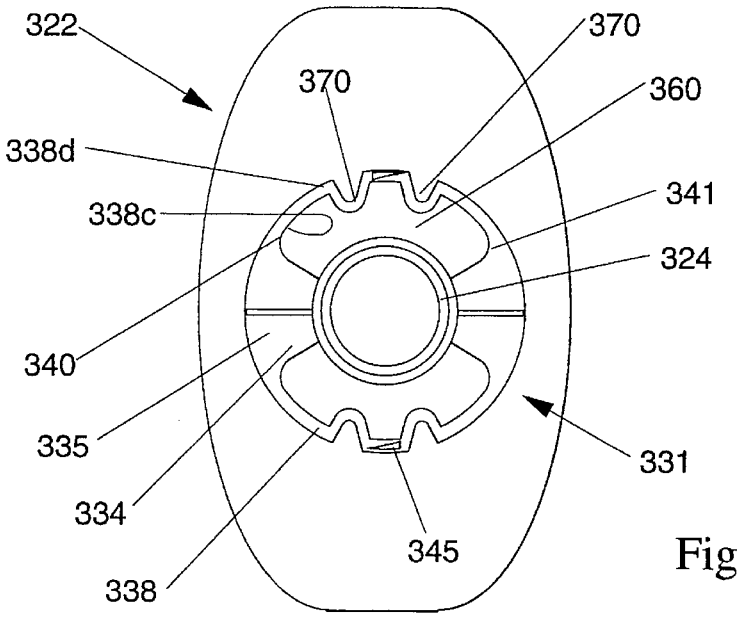
FIG. 8 is a top plan view of the bottle of FIG. 7.
Figure 7:
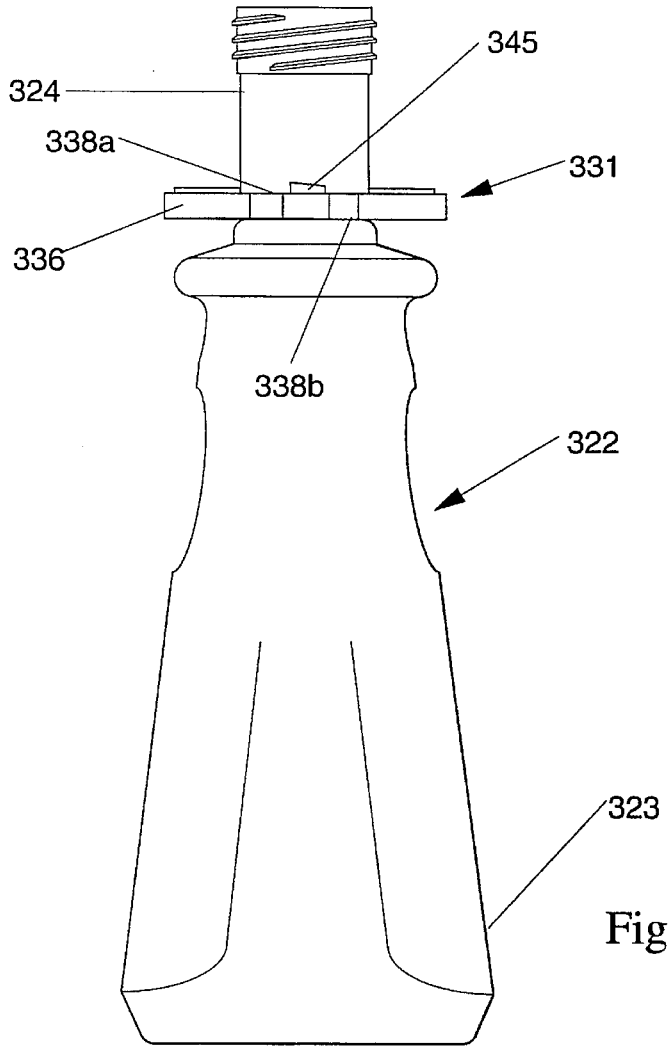
FIG. 7 is a side elevation view of another preferred embodiment of a bottle of the present invention wherein the finish portion includes an integrally molded child resistant feature.

FIGS. 7 and 8 show an alternative embodiment of a bottle 322 of the present invention. Bottle 322 comprises a base 323 and a cylindrical finish portion 324. Finish portion 324 includes threads 330 on its outermost surface. Finish portion 324 also includes a child resistant feature, generally designated 331. Child resistant feature 331 in integrally molded with the finish portion 324. Child resistant feature 331 includes a platform 334 extending radially outward from finish portion 324. The platform 334 has a substantially planar surface 335 and an outermost surface 336. The outermost surface 336 of platform 334 is generally concentrically aligned with the finish portion 324. Extending from and secured to platform 334 is a pair of pushtabs 338. Pushtabs 338 include an uppermost surface 338*a*, a lowermost surface 338*b*, an innermost surface 338*c*, and an outermost surface 338*d*. The outermost surface 338*a* is generally concentrically aligned with the finish portion 324 and generally conforms to the contours of the outermost surface 336 of platform 334. The pushtabs 338 include a first end 340 and a second end 341. Both the first end 340 and the second end 341 are secured to platform 334. At the junction of pushtab 338 with platform 334 is a radiused portion which allows pushtabs 338 to flex inward.

The uppermost surface of each pushtab 338 has a vertical extension 345 which projects above the plane of the uppermost surface 338*a* of pushtab 338. Vertical extensions 345 interlock with pawls 55 on the innermost surface of skirt 52 of closure 50, shown in FIGS. 3, 4A and 4B, when closure 50 is fully threaded onto finish portion 324. During assembly of closure 50 onto finish portion 324, pawls 55 must rotate past vertical extensions 45. However, vertical extensions 345 interfere with the rotation of pawls 55 and cause pushtabs 338 to be resiliently deflected inwardly. Gradual lead in ramps on pawls 55 facilitate the deflection. The mating surface of vertical extensions 345 is profiled to minimize the reapplication torque required to fully seat closure 50 onto finish portion 324. Continued rotation of closure 50 causes pawls 55 to clear vertical extension 345, thereby permitting pushtabs 338 to return to their latched condition.

Clearance in opening 360 between the innermost surface 338C of pushtab 338 and finish portion 324 permits sufficient inward deflection of pushtabs 338 to clear pawls 55 when the user wants to apply sufficient unscrewing torque to remove the closure from the finish portion 324. Pushtabs 338 include a pair of curved spring elements 370 which create a uniform spring force during inward deflection of pushtabs 338.

While in an extended condition, similar to that shown in FIG. 4A, vertical extensions 345 impede counter-clockwise rotation of pawls 55 when attempting to remove the closure. In order to remove the closure from finish portion 324 once the closure has been fully assembled onto the finish portion, sufficient manual pressure must be applied to pushtab 338 such that vertical extensions 345 on pushtab 338 fully disengage pawls 55. The squeezing force required to depress pushtabs 338 is preferably great enough to be difficult for a child, yet low enough that adults can readily depress the opposing pushtab 338 while concurrently applying an unscrewing torque to the closure.

In addition, the outermost surface 338*a* of pushtab 338 are preferably concentrically aligned with finish portion 324 and conform to the contour of the exterior surface 336 of platform 334 so that simply grasping the platform about its periphery and squeezing is unlikely to permit both vertical extensions 345 on the opposed pushtabs 338 to become inadvertently disengaged from pawls 55 at the same time an unscrewing torque is being applied to the closure. Rather a conscious decision must be made by the user to initiate the opening process and this must be accompanied by a concurrent application of unscrewing torque to the closure. This minimized the closure that a child will be able to remove the closure simply by squeezing the entire periphery of platform 334 in his or her hand while trying to unscrew the closure.

By referring back to FIGS. 1 and 4A, after the closure 50 is secured onto the finish portion 24 in its latched position, the closure can then be turned in the counter clockwise rotation, shown as T in FIG. 4A, for some small predetermined distance without activating the push tabs and releasing the closure from its latched position. This is a design feature which provides some "over-travel" or "bypass" of the closure, defined as the radial rotation, counter to direction T, of the closure past the latched position of the pushtabs. This bypass is so the package will not jam, which could happen if the tab engagement position is close to the point at which the closure is fully secured onto the finish portion. Therefore, the package 20 further includes a means for sealing the closure to the finish portion of the bottle when the closure is in its latched position so that the closure can be rotated in a counter clockwise direction T without disengaging the pushtab and without unsealing the closure from the finish portion.

Figure 9:
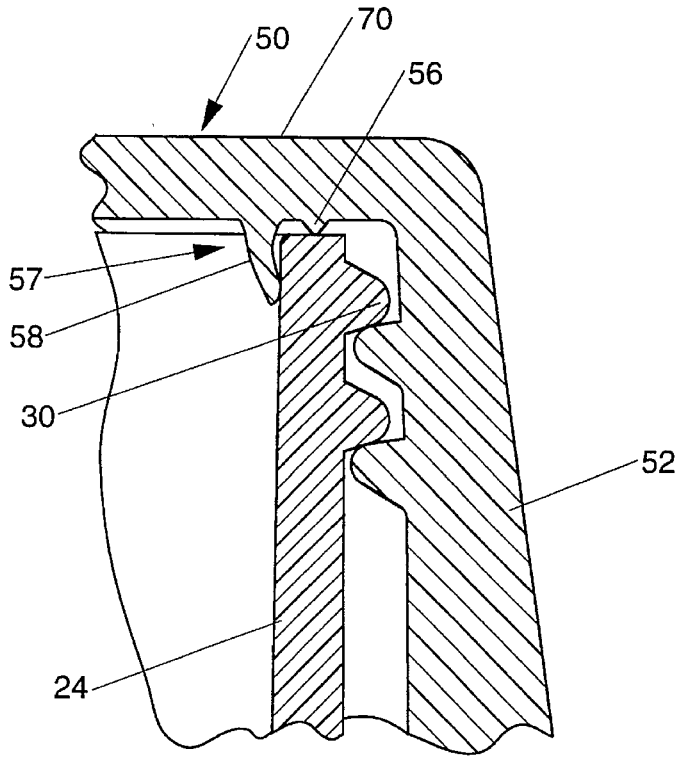
FIG. 9 is a simplified cross-sectional view of cap 50 and finish portion 24 taken along line 9—9 of FIG. 3.
Figure 10:
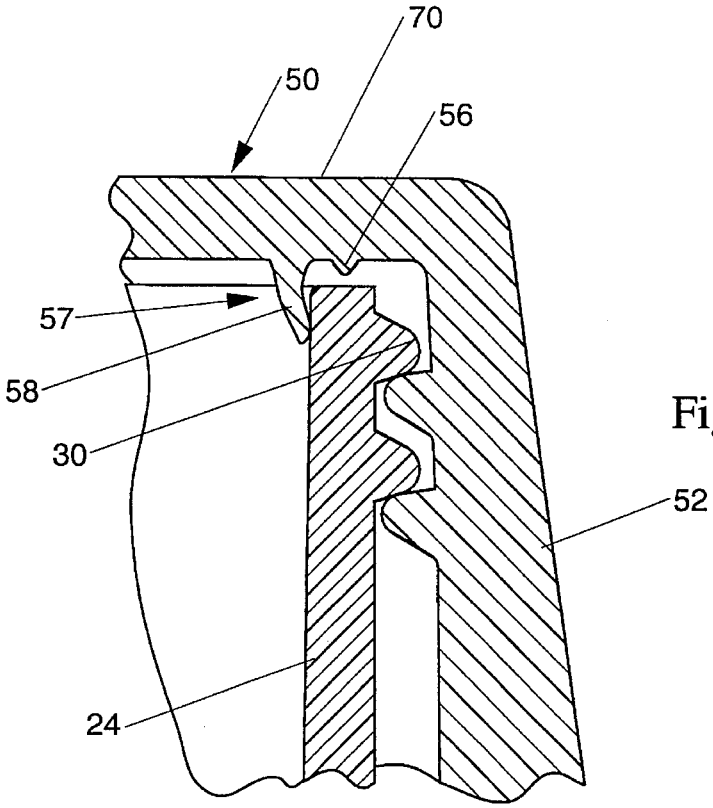
FIG. 10 is view similar to that of FIG. 9 wherein the cap has been rotated in a reverse direction, but without the resiliently deformable pushtabs being depressed.

This means for sealing the closure onto the finish portion can best be described by referring to FIGS. 9 and 10. As seen from FIG. 9 the means for sealing the closure 50 onto the finish portion 24 comprises a re-entrant plug seal 57 located along the top 70 of closure 50. Plug seal 57 comprises member 58 which is inwardly spaced from skirt 52 and is radially disposed along the top 70 of cap 50. Member 58 is biased against the inside of the finish portion 24 so that when the closure is in its latched position, as shown in FIG. 9, the closure can be rotated in a counter clockwise direction T, without disengaging the pushtab and without unsealing the closure from the finish portion, as shown in FIG. 10. As seen from FIG. 10, the closure can be rotated in a counter clockwise direction T without disengaging the pushtab and without unsealing the plug seal 58 from the finish portion. This plug seal design also allows the closure to be sealed to the finish portion before the closure is fully rotated to its latched position. The plug seal maintains a line contact like an O-ring. Plug seal 58 is preferably integrally molded with closure 50.

The closure 50 also includes a V-seal 56 to help better seal the package when the closure is fully torqued onto the finish portion.

While particular embodiments of the present invention have been illustrated and described, it would be obvious to those skilled in the art that various other changes and modifications can be made without departing from the spirit and scope of the invention. It is therefore, intended to cover in the appended claims all such changes and modifications that are within the scope of this invention.

What is claimed is:

1. A child-resistant package for storing and dispensing material, comprising:

(a) a bottle including a base and a finish portion, said finish portion having an innermost surface and an outermost surface, said finish portion including a first means for rotatably and releasably securing a closure to said finish portion on at least one of its surfaces, a platform extending radially outward from said finish portion, said platform having an outermost surface being generally concentrically aligned with said finish portion, and at least one resiliently deformable pushtab having a first end and a second end, at least one of said ends being secured to said platform, each of said at least one pushtab having an uppermost surface, a lowermost surface, an innermost surface, and an outermost surface, said outermost surface of said pushtab being generally concentrically aligned with said finish portion and generally conforming to the contour of said exterior surface of the adjacent portions of said platform to minimize the chance of inadvertent depression thereof when said platform is grasped, said at least one pushtab having a vertical extension projecting above said uppermost surface of said at least one pushtab, said at least one pushtab being inwardly moveable relative to the rest of said platform when a force is applied to said outermost surface of said at least one pushtab;

(b) a closure having a skin, said skirt having an innermost surface and an outermost surface, said skirt including on at least one of its surfaces second means complementary to said first means for rotatably and releasably securing said closure to said finish portion, said skirt having at least one interlocking pawl on its innermost surface wherein each of said at least one interlocking pawl corresponds to only one of said vertical extension, said at least one interlocking pawl being shaped and positioned to deflect said corresponding vertical extension on said at least one resiliently deformable pushtab when said closure is rotatably secured onto said finish portion in a latched position and releasing said closure from said finish portion by rotating said closure in a reverse direction when said at least one resiliency deformable pushtab is first depressed to disengage said at least one pushtab's vertical extension from said interlocking pawl; and (c) a seal on said innermost surface of said closure for providing sealing engagement between said closure and said finish portion of said bottle at least when said at least one interlocking pawl engages said corresponding vertical extension in said latched position, said seal being configured so as to be biased against said finish portion so that after said cap is rotatably secured onto said finish portion, said cap can be rotated in a reverse direction, to a point at which said at least one interlocking pawl and said at least one pushtab come into contact, without breaking said sealing engagement between said seal and said finish portion.

2. The package of claim 1, wherein said first and second means for rotatably and releasasbly securing said closure to said finish portion comprises complementary screw threads.

3. The package of claim 1, wherein the force required to sufficiently depress said at least one resiliently deformable pushtab to disengage said vertical extension from said at least one interlocking pawl is approximately 0.5 to 5 pounds force.

4. The package of claim 1, wherein said platform includes a pair of substantially opposed resiliently deformable pushtabs having vertical extensions which engage a pair of substantially opposed interlocking pawls.

5. The package of claim 4, wherein the force required to sufficiently depress said pair of substantially opposed resiliently deformable pushtabs to disengage said vertical extensions from said pair of substantially opposed interlocking pawls is approximately 0.5 to 5 pounds force.

6. The package of claim 1, wherein said platform includes a pushtab stop, thereby preventing said at least one pushtab from being depressed too far inwardly causing damage to said at least one pushtab.

7. The package of claim 1, wherein said bottle and said finish portion comprise at least one of polyethylene, polyethylene, polyester, polycarbonate, polyvinyl chloride, and polystyrene.

8. The package of claim 1, wherein said closure comprises at least one of polypropylene, polyethlene, polyester, polycarbonate, polyvinyl chloride, and polystyrene.

9. The package of claim 1, wherein said seal comprises a reentrant plug seal, said plug seal comprising a member having first and second ends, said first end being radially disposed on said innermost surface of said closure and inwardly spaced from said skirt, said second end of said member being biased against said innermost surface of said finish portion.

10. A child-resistant package for storing and dispensing material, comprising:

(a) a bottle including a base and a finish portion, said finish portion having an innermost surface and an outermost surface, said finish portion including a first means for rotatably and releasably securing a closure to said finish portion on at least one of its surfaces, a platform extending radially outward from said finish portion, said platform having an outermost surface being generally concentrically aligned with said finish portion, and at least one resiliently deformable pushtab having a first end and a second end, said first and second ends of said at least one pushtab being secured to said platform, each of said at least one pushtab having an uppermost surface, a lowermost surface, an innermost surface, and an outermost surface, said outermost surface of said at least one pushtab being generally concentrically aligned with said finish portion and generally conforming to the contour of said exterior surface of the adjacent portions of said platform to minimize the chance of inadvertent depression thereof when said platform is grasped, said at least one pushtab having a vertical extension projecting above said uppermost surface of said at least one pushtab, said at least one pushtab being inwardly moveable relative to the rest of said platform when a squeezing force is applied to said outermost surface of said at least one pushtab;

(b) a closure having a skirt, said skirt having an innermost surface and an outermost surface, said skirt including on at least one of its surfaces second means complementary to said first means for rotatably and releasably securing said closure to said finish portion, said skirt having at least one interlocking pawl on its innermost surface wherein each of said at least one interlocking pawl corresponds to only one of said vertical extension, said at least one interlocking pawl being shaped and positioned to deflect said vertical extension on said resiliently deformable at least one pushtab when said closure is rotatably secured onto said finish portion in a latched position, and releasing said closure from said finish portion by rotating said closure in a reverse direction when said at least one resiliently deformable pushtab is first depressed to disengage said at least one pushtab's vertical extension from said at least one interlocking pawl; and (c) a seal on said innermost surface of said closure for providing sealing engagement between said closure and said finish portion of said bottle in a sealing zone which occurs between the point when said at least one interlocking pawl is in said latched position and the point when said closure is fully rotatably secured onto said finish portion, said seal being configured so as to be biased against said finish portion so that after said cap is rotatably secured onto said finish portion, said cap can be rotated in a reverse direction, to a point at which said at least one interlocking pawl and said at least one pushtab come into contact, without breaking said sealing engagement between said seal and said finish portion.

11. The package of claim 10, wherein said first and second means for rotatably and releasably securing said closure to said finish portion comprises complementary screw threads.

12. The package of claim 10, wherein the force required to depress said at least one resiliently deformable pushtab a sufficient distance to disengage said vertical extension from said at least one interlocking pawl is in the range of about 0.5 to about 5 pound force.

13. The package of claim 10, wherein said platform includes a pair of substantially opposed resiliently deformable pushtabs.

14. The package of claim 13, wherein the force required to depress said substantially opposed resiliently deformable pushtabs a sufficient distance to disengage said vertical extensions from said at least one interlocking pawls is in the range of about 0.5 to about 5 pounds force.

15. The package of claim 10, wherein said platform includes a pushtab stop preventing said at least one pushtab from being depressed too far inwardly causing damage to said at least one pushtab.

16. The package of claim 10, wherein said bottle and said finish portion are are comprised of a material selected from the group consisting of polypropylene, polyethylene, polyester, polycarbonate, polyvinyl chloride, and polystyrene.

17. The package of claim 10, wherein said closure is comprised of a material selected from the group consisting of polypropylene, polyethylene, polyester, polycarbonate, polyvinyl chloride, and polystyrene.

18. The package of claim 10, wherein said seal comprises a re-entrant plug seal, said plug seal comprising a member radially disposed on said innermost surface of said closure, said member being inwardly spaced from said skirt and being biased against the inside of said finish portion.

19. A child-resistant package for storing and dispensing a liquid, comprising:

(a) a bottle including a base and a finish portion, said finish portion having an innermost surface and an outermost surface, said finish portion including a first means for rotatably and releasably securing a closure to said finish portion on at least one of its surfaces, a platform extending radially outward from said finish portion, said platform having an outermost surface being generally concentrically aligned with said finish portion, and first and second substantially opposed resiliently deformable pushtabs, each having a first end and a second end, said first and second ends of said first and second pushtabs being secured to said platform, said first and second pushtabs having an uppermost surface, a lowermost surface, an innermost surface, and an outermost surface, said outermost surface of said first and second pushtabs being generally concentrically aligned with said finish portion and generally conforming to the contour of said exterior surface of the adjacent portions of said platform, said first and second pushtabs having a vertical extension projecting above said uppermost surface of said first and second pushtabs, said first and second pushtabs being inwardly moveable relative to said platform when a squeezing force is applied to said outermost surface of said first and second pushtabs;

(b) a closure having a skirt, said skirt having an innermost surface and an outermost surface, said skirt including on at least one of its surfaces second means complementary to said first means for rotatably and releasably securing said closure to said finish portion, said skirt having first and second interlocking pawls on its innermost surface wherein said first and second interlocking pawls correspond to said vertical extension of said first and second pushtabs, respectively, said interlocking pawls being shaped and positioned to substantially simultaneously deflect said vertical extension on said first and second resiliently deformable pushtabs in a latched position, thereby producing a substantially single auditory snap-lock when said closure is rotatably secured onto said finish portion, said interlocking pawls also being shaped and positioned to release said closure from said finish portion by rotating said closure in a reverse direction when said first and second resiliency deformable pushtabs are first depressed to disengage said first and second pushtab's vertical extension from said first and second interlocking pawls, respectively; and (c) a seal on said innermost surface of said closure for providing sealing engagement between said closure and said finish portion of said bottle in a sealing zone which occurs when said first and second interflocking pawls are in said latched position and said closure is rotatably secured onto said finish portion, said seal being configured so as to be biased against said finish portion so that after said cap is rotatably secured onto said finish portion, said cap can be rotated in a reverse direction, to a point at which said first and second pawls and said first and second pushtabs, respectfully, come into contact, without breaking said sealing engagement between said seal and said finish portion.

* * * * *

UNITED STATES PATENT AND TRADEMARK OFFICE
CERTIFICATE OF CORRECTION

PATENT NO. : 5,586,671

DATED : December 24, 1996

INVENTOR(S) : Hewin N. Thomas - Jack E. Haney - Peter W. Hamilton

It is certified that error appears in the above-identified patent and that said Letters Patent is hereby corrected as shown below:

Column 1, line 56, delete "skin" and insert --skirt--

Column 1, line 62, delete "skin" and insert --skirt--

Column 2, line 67, delete "into" and insert --onto--

Column 3, line 31, after "includes", insert --a--

Column 6, line 56, after "231", delete "in" and insert --is--

Column 7, line 61, after "331", delete "in" and insert --is--

Column 8, line 61, delete "closure" and insert --chance--

Claim 1, column 10, line 5, delete "skin" and insert --skirt--

Claim 1, column 10, line 19, delete "resiliency" and insert --resiliently--

Claim 2, column 10, line 36, delete "releasasbly" and insert --releasably--

Claim 14, column 12, line 10, delete "pawls" and insert --pawl--

Claim 16, column 12, line 16, delete second "are"

Claim 19, column 14, line 9, delete "respectfully" and insert --respectively--

Signed and Sealed this

Second Day of September, 1997

*Attest:*

Bruce Lehman

BRUCE LEHMAN

*Attesting Officer*

*Commissioner of Patents and Trademarks*